US009643412B1

(12) United States Patent
Takemoto et al.

(10) Patent No.: US 9,643,412 B1
(45) Date of Patent: May 9, 2017

(54) EJECTION APPARATUS

(71) Applicant: FUJI XEROX CO., LTD., Tokyo (JP)

(72) Inventors: Norihisa Takemoto, Kanagawa (JP); Atsushi Murakami, Kanagawa (JP); Manabu Numata, Kanagawa (JP); Hiroshi Ikeda, Kanagawa (JP); Susumu Hirakata, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 15/237,722

(22) Filed: Aug. 16, 2016

(30) Foreign Application Priority Data

Jan. 29, 2016 (JP) ..... 2016-015610

(51) Int. Cl.
*B41J 2/045* (2006.01)
*B41J 2/14* (2006.01)

(52) U.S. Cl.
CPC ..... *B41J 2/04563* (2013.01); *B41J 2/04586* (2013.01); *B41J 2/04531* (2013.01); *B41J 2002/14467* (2013.01)

(58) Field of Classification Search
CPC .. B41J 2/14056; B41J 2/0458; B41J 2/04563; B41J 2/04528; B41J 2/04531; B41J 2002/14467
See application file for complete search history.

(56) References Cited

U.S. PATENT DOCUMENTS 6,331,050 B1 * 12/2001 Nakata ..... B41J 2/14024 347/65
6,474,769 B1 * 11/2002 Imanaka ..... B41J 2/04541 347/19

FOREIGN PATENT DOCUMENTS

| | | |
|---|---|---|
| JP | 2007-196479 | 8/2007 |
| JP | 2014-144567 | 8/2014 |
| JP | 2015-089624 | 5/2015 |

OTHER PUBLICATIONS

Abstract and machine translation of JP 2007-0196479.
Abstract and machine translation of JP 2014-0144567.
Abstract and machine translation of JP 2015-089624.

* cited by examiner

*Primary Examiner* — Thinh H Nguyen
(74) *Attorney, Agent, or Firm* — Fildes & Outland, P.C.

(57) ABSTRACT

An ejection apparatus is provided with a plurality of ejection units, a controller that controls a temperature of a liquid, and a supply mechanism that includes a plurality of supply units. The plurality of supply units flow the liquid in a predetermined flow direction. Respective portion of the plurality of supply units in the flow direction are connected to the ejection units to supply the liquid to the ejection units. A downstream side portion of one of the supply units in the flow direction is connected to another one of supply units via a heat transfer member.

5 Claims, 8 Drawing Sheets

EJECTION APPARATUS

CROSS-REFERENCE TO RELATED APPLICATIONS

This application is based on and claims priority under 35 USC 119 from Japanese Patent Application No. 2016-015610 filed Jan. 29, 2016.

BACKGROUND

Technical Field

The present invention relates to an ejection apparatus.

SUMMARY

According to an aspect of the invention, an ejection apparatus is provided with a plurality of ejection units, a controller that controls a temperature of a liquid, and a supply mechanism that includes a plurality of supply units. The plurality of supply units flow the liquid in a predetermined flow direction. Respective portion of the plurality of supply units in the flow direction are connected to the ejection units to supply the liquid to the ejection units. A downstream side portion of one of the supply units in the flow direction is connected to another one of supply units via a heat transfer member.

BRIEF DESCRIPTION OF THE DRAWINGS

Exemplary embodiments of the present invention will be described in detail based on the following figures, wherein.

DETAILED DESCRIPTION

Hereinafter, an example of exemplary embodiments of the invention will be described with reference to the drawings.

<Image Forming Apparatus 10>

Figure 1:
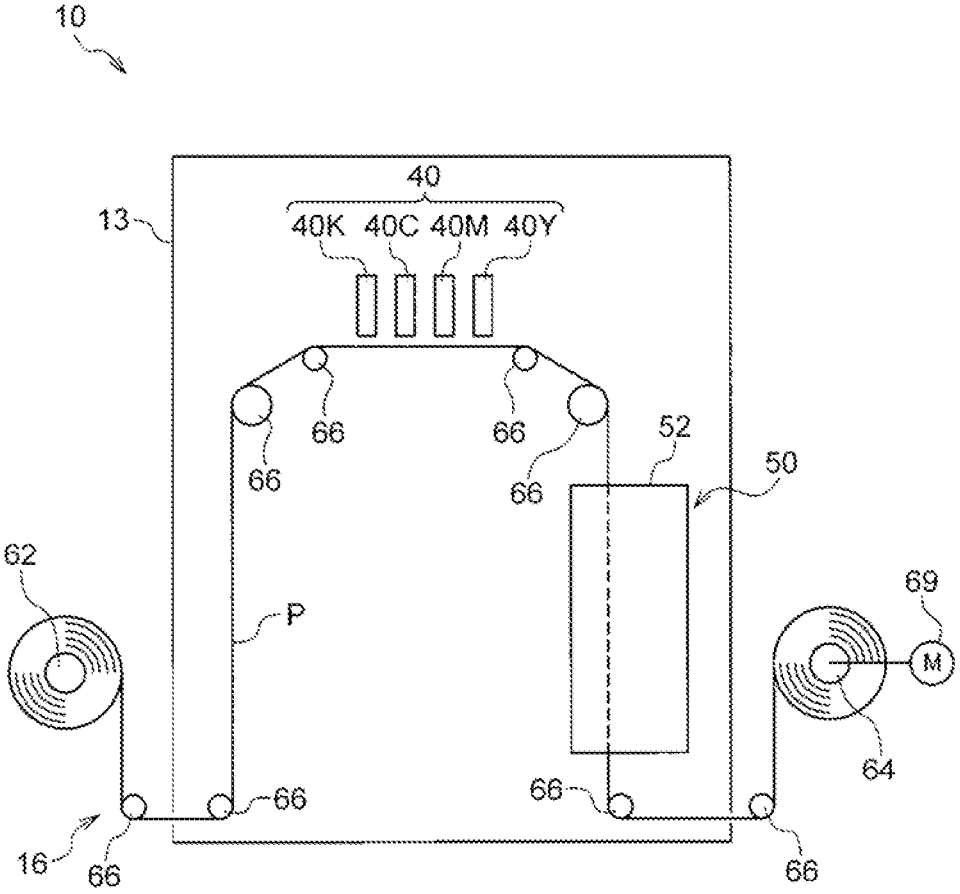
FIG. 1 is a schematic diagram illustrating the configuration of an image forming apparatus according to the present exemplary embodiment.

First, an image forming apparatus 10 as an example of an ejection apparatus for ejecting a liquid will be described. FIG. 1 is a schematic diagram illustrating the configuration of the image forming apparatus 10.

As illustrated in FIG. 1, the image forming apparatus 10 includes an image forming apparatus main body 13 (housing), and a transport unit 16 transporting a continuous form paper P (recording medium). In addition, the image forming apparatus 10 includes an ejection unit 40 ejecting ink droplets on the continuous form paper P, an ink supply mechanism 70 (refer to FIG. 2) supplying ink droplets (an example of liquid) to the ejection unit 40, and a drying device 50 drying the ink on the continuous form paper P.

The ejection unit 40 and the drying device 50 are disposed in this order from the upstream side toward the downstream side in the transport direction of the continuous form paper P. Accordingly, an ejection operation and a drying operation are performed in this order, on each portion of the continuous form paper P that is transported by the transport unit 16.

<Transport Unit 16>

The transport unit 16 includes an unwinding roll 62 unwinding the continuous form paper P, a winding roll 64 winding the continuous form paper P, and plural transport rolls 66 transporting the continuous form paper P. The winding roll 64 is rotatably driven by a drive unit 69. Accordingly, the winding roll 64 winds the continuous form paper P, and the unwinding roll 62 unwinds the continuous form paper P.

The plural transport rolls 66 are wound with the continuous form paper P between the unwinding roll 62 and the winding roll 64. Accordingly, the transporting path of the continuous form paper P from the unwinding roll 62 to the winding roll 64 is determined. The winding roll 64 winds the continuous form paper P, and thus the plural transport rolls 66 are driven to rotate by the continuous form paper P which progresses to the winding roll 64 side.

<Drying Device 50>

The drying device 50 includes a housing 52, and plural infrared heaters (not illustrated) as a heating source that are disposed at the inside of the housing 52. The plural infrared heaters (not illustrated) are disposed, for example, along the vertical direction, facing the image forming surface (the surface on which the ink droplets are ejected from the ejection unit 40) of the continuous form paper P which is transported in the inside of the housing 52. The plural infrared heater (not illustrated) heats the image forming surface of the continuous form paper P, and thus the drying device 50 dries the ink on the image forming surface.

<Ejection Unit 40>

The ejection unit 40 includes ejection heads 40Y, 40M, 40C, and 40K (hereinafter, referred to as 40Y to 40K) that eject ink droplets (an example of droplets) of respective colors of yellow (Y), magenta (M), cyan (C), and black (K) on the continuous form paper P. The ejection heads 40Y to 40K eject the ink droplets of the respective colors on the continuous form paper P, and thus an image is formed on the continuous form paper P.

Figure 2:
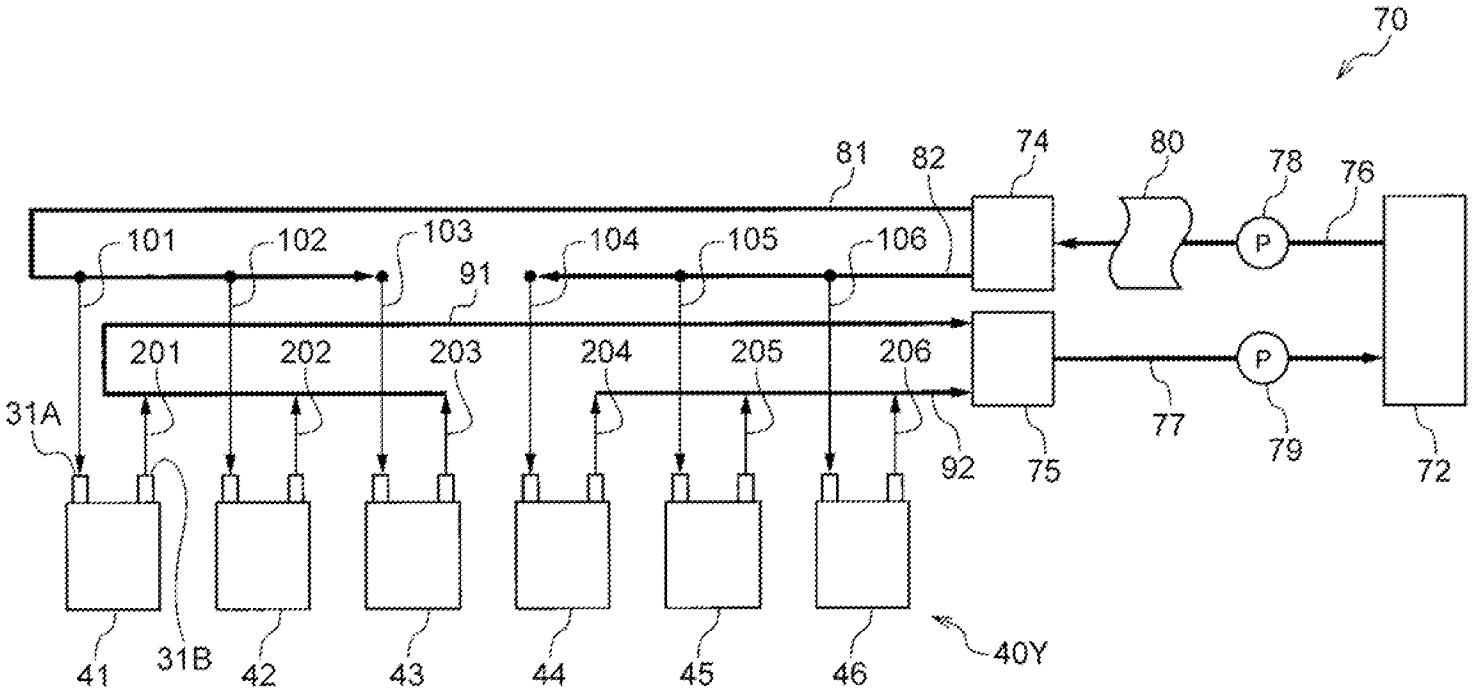
FIG. 2 is a schematic diagram illustrating the configuration of an ink supply mechanism according to the present exemplary embodiment.

As illustrated in FIG. 2, the ejection heads 40Y to 40K are provided with multiple (specifically, for example, six) ejection modules 41, 42, 43, 44, 45, and 46 (an example of the ejection unit) that eject ink (ink droplets), respectively.

The ejection modules 41, 42, 43, 44, 45, and 46 (hereinafter, referred to as 41 to 46) are disposed along the width direction of the continuous form paper P (an example of a predetermined disposition direction) in this order from one end to the other end in the width direction. Accordingly, the ejection modules 41 to 46 respectively form each portion from one end to the other end in the width direction of the image on the continuous form paper P. The width direction of the continuous form paper P is an intersection direction intersecting with the transport direction of the continuous form paper P.

In the present exemplary embodiment, the ejection module 43 functions as an example of a first ejection unit that is disposed in the center side of the disposition direction, and the ejection module 41 functions as an example of a second ejection unit that is disposed at the one end of the disposition direction. The ejection module 44 functions as an example of a third ejection unit that is opposite to the first ejection unit and adjacent to the first ejection unit at the other end of the disposition direction with respect to the first ejection unit. The ejection module 46 functions as an example of a fourth ejection unit that is disposed at the other end of the disposition direction.

Each of the ejection modules 41 to 46 is provided with a supply port 31A that can supply the ink to the inside of the ejection modules 41 to 46 from the outside of the ejection modules 41 to 46, and an exit port 31B that can discharge the ink supplied through the supply port 31A to the outside of the ejection modules 41 to 46 from the inside of the ejection modules 41 to 46. Each of the ejection modules 41 to 46 is configured in the same manner.

<Ink Supply Mechanism 70>

As illustrated in FIG. 2, the ink supply mechanism 70 is provided for each of the ejection heads 40Y to 40K. Here, the ink supply mechanism 70 provided for the ejection head 40Y will be described.

The ink supply mechanism 70 includes an ink tank 72 that stores the ink of yellow (Y), a supply-side tank 74 that temporarily stores the ink of yellow (Y), and a discharge-side tank 75 that temporarily stores the ink of yellow (Y).

A supply pipe 76 that supplies the ink to the supply-side tank 74 from the ink tank 72 is connected to the ink tank 72 and the supply-side tank 74. A discharge pipe 77 that discharges the ink to the ink tank 72 from the discharge-side tank 75 is connected to the ink tank 72 and the discharge-side tank 75.

A supply pump 78 that sends the ink to the supply-side tank 74 from the ink tank 72 and a temperature controller 80 (an example of a controller) that controls the temperature of the ink are provided in this order from the upstream side of the supply pipe 76.

A discharge pump 79 that sends the ink to the ink tank 72 from the discharge-side tank 75 is provided at the discharge pipe 77.

The supply-side tank 74 is connected to each of the one ends (upstream ends) of a first common supply pipe 81 (an example of one supply unit) and a second common supply pipe 82 (an example of another supply unit) through which the ink having a temperature controlled by the temperature controller 80 flows in a predetermined flow direction.

The one ends of individual supply pipes 101, 102, and 103 are connected to the other end (downstream end side) of the first common supply pipe 81 opposite to the one end thereof at each portion of the first common supply pipe 81 in the flow direction (different positions in the flow direction). More specifically, the one ends of the individual supply pipes 101, 102, and 103 are connected to the first common supply pipe 81 in order of the individual supply pipes 101, 102, and 103 from the one end side (upstream end side) of the first common supply pipe 81.

The other ends of the individual supply pipes 101, 102, and 103 are respectively connected to the supply ports 31A of the corresponding ejection modules 41, 42, and 43. Thus, each portion of the first common supply pipe 81 in the flow direction is respectively connected to each of the ejection modules 41, 42, and 43 via the individual supply pipes 101, 102, and 103. Therefore, the ink is supplied to the ejection modules 41, 42, and 43.

The one ends of individual supply pipes 106, 105, and 104 are connected to the other end (downstream end side) of the second common supply pipe 82 opposite to the one end thereof at each portion of the second common supply pipe 82 in the flow direction (different positions in the flow direction). More specifically, the one ends of the individual supply pipes 106, 105, and 104 are connected to the second common supply pipe 82 in order of the individual supply pipes 106, 105, and 104 from the one end side (upstream end side) of the second common supply pipe 82.

The other ends of the individual supply pipes 106, 105 and 104 are respectively connected to the supply ports 31A of the corresponding ejection modules 46, 45, and 44. Thus, each portion of the second common supply pipe 82 in the flow direction is respectively connected to each of the ejection modules 46, 45, and 44 via the individual supply pipes 106, 105, and 104. Therefore, the ink is supplied to the ejection modules 46, 45, and 44.

In the present exemplary embodiment, each of the supply pipes 76, 81, 82, 101, 102, 103, 106, 105, and 104 (hereinafter, referred to as 76 to 104) includes, for example, a resin tube. Each of the supply pipes 76 to 104 is not limited to the resin tube, and may be a metallic pipe, for example. The constituent material of each of the supply pipes 76 to 104 is not limited to a particular material. In addition, a supply path (flow channel) along which the ink flows is formed in each of the supply pipes 76 to 104.

The one end (downstream end) of a first common discharge pipe 91 and the one end (downstream end) of a second common discharge pipe 92 are connected to the discharge-side tank 75.

The one ends of individual discharge pipes 201, 202, and 203 are connected to the other end side (upstream end side) of the first common discharge pipe 91 opposite to the one end thereof at each portion of the first common discharge pipe 91 in the flow direction (different positions in the flow direction). More specifically, the one ends of the individual discharge pipes 201, 202, and 203 are connected to the first common discharge pipe 91 in order of the individual discharge pipes 201, 202, and 203 from the one end side (upstream end side) of the first common discharge pipe 91.

The other ends of the individual discharge pipes 201, 202, and 203 are respectively connected to the exit ports 31B of the corresponding ejection modules 41, 42, and 43.

The one ends of individual discharge pipes 206, 205, and 204 are connected to the other end side (upstream end side) of the second common discharge pipe 92 opposite to the one end thereof at each portion of the second common discharge pipe 92 in the flow direction (different positions in the flow direction). More specifically, the one ends of the individual discharge pipes 206, 205, and 204 are connected to the second common discharge pipe 92 in order of the individual discharge pipes 206, 205, and 204 from the one end side (downstream end side) of the second common discharge pipe 92.

The other ends of the individual discharge pipes 206, 205, and 204 are respectively connected to the exit ports 31B of the corresponding ejection modules 46, 45, and 44. In the present exemplary embodiment, each of the discharge pipes 77, 91, 92, 201, 202, 203, 206, 205, and 204 (hereinafter, referred to as 77 to 204) includes, for example, a resin tube.

Each of the discharge pipes 77 to 204 is not limited to the resin tube, and may be a metallic pipe, for example. The constituent material of each of the discharge pipes 77 to 204 is not limited to a particular material. In addition, a discharge path (flow channel) along which the ink flows is formed in each of the discharge pipes 77 to 204.

In the ink supply mechanism 70, the supply pump 78 sends the ink to the supply-side tank 74 from the ink tank 72, and thus a positive pressure is generated at the supply-side tank 74. The discharge pump 79 sends the ink to the ink tank 72 from the discharge-side tank 75, and thus a negative pressure is generated at the discharge-side tank 75. By the differential pressure between the supply-side tank 74 and the discharge-side tank 75, the ink that is sent to the supply-side tank 74 from the ink tank 72 flows through the first common supply pipe 81, the second common supply pipe 82 and the individual supply pipes 101, 102, 103, 104, 105, and 106, and then the ink is supplied to each of the ejection modules 41 to 46 via the supply port 31A of each of is the ejection modules 41 to 46.

Further, the ink that is supplied to each of the ejection modules 41 to 46 flows through the individual discharge pipes 201, 202, 203, 204, 205, and 206, the first common discharge pipe 91, and the second common discharge pipe 92, and then the ink is discharged (collected) to the discharge-side tank 75. The ink that is discharged to the discharge-side tank 75 is sent to the ink tank 72 by the discharge pump 79.

As described above, in the ink supply mechanism 70, a circulation path for circulating the ink in the ink tank 72 is formed by the supply pipe 76, the supply-side tank 74, the first common supply pipe 81, the second common supply pipe 82, the individual supply pipes 101, 102, 103, 104, 105, and 106, the ejection modules 41 to 46, the individual discharge pipes 201, 202, 203, 204, 205, and 206, the first common discharge pipe 91, the second common discharge pipe 92, the discharge-side tank 75, and the discharge pipe 77. The ink circulates through the circulation path.

Figure 3:
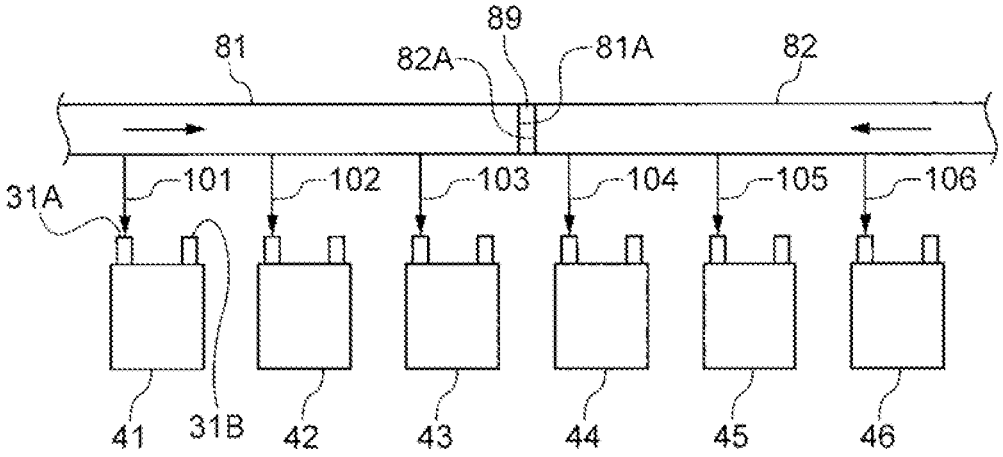
FIG. 3 is a schematic diagram illustrating the configuration in which the downstream side portions of two common supply pipes according to the present exemplary embodiment are connected to each other.

Here, in the present exemplary embodiment, as illustrated in FIG. 3, the downstream side portion of the first common supply pipe 81 in the flow direction is connected to the downstream side portion of the second common supply pipe 82 in the flow direction via a heat transfer member 89 that transfers heat. Specifically, the downstream side end portion 81A of the first common supply pipe 81 in the flow direction is connected to the downstream side end portion 82A of the second common supply pipe 82 in the flow direction, and the first common supply pipe 81 and the second common supply pipe 82 are disposed in series. The heat transfer member 89 is formed of, for example, a metal member such as aluminum.

The downstream side portion of the first common supply pipe 81 in the flow direction is, for example, a portion that is at the further downstream side in the flow direction than a portion in which the ejection module 42 that is disposed in second when counting from the downstream end side of the first common supply pipe 81 is connected to the first common supply pipe 81 (a connection portion between the first common supply pipe 81 and the individual supply pipe 102).

Therefore, the ejection modules 41 and 42 are connected to the first common supply pipe 81 at the upstream side portion of the first common supply pipe 81 opposite to the downstream side portion thereof.

The downstream side portion of the second common supply pipe 82 in the flow direction is, for example, a portion that is at the further downstream side in the flow direction than a portion in which the ejection module 45 that is disposed in second when counting from the downstream end side of the second common supply pipe 82 is connected to the second common supply pipe 82 (a connection portion between the second common supply pipe 82 and the individual supply pipe 105).

Therefore, the ejection modules 45 and 46 are connected to the second common supply pipe 82 at the upstream side portion of the second common supply pipe 82 opposite to the downstream side portion thereof.

In FIG. 2, the distance from the supply-side tank 74 to the connection portion between the first common supply pipe 81 and the individual supply pipe 101 is illustrated to be longer than the distance from the supply-side tank 74 to the connection portion between the second common supply pipe 82 and the individual supply pipe 106. However, in fact, the distances are the same. Accordingly, the influence of the in external environment temperature to which the ink that is supplied to the individual supply pipe 101 from the supply-side tank 74 is subjected is the same as the influence of the external environment temperature to which the ink that is supplied to the individual supply pipe 106 from the supply-side tank 74 is subjected.

<Operation According to Exemplary Embodiment>

Operations of the exemplary embodiment will be described.

In the exemplary embodiment, as illustrated in FIG. 2, the ink in the ink tank 72 circulates through the circulation path that is formed by the supply pipes 76 to 104, the supply-side tank 74, the discharge-side tank 75, and the discharge pipes 77 to 204. Accordingly, the ink that has a temperature controlled by the temperature controller 80 is supplied to the ejection modules 41, 42, and 43 via the supply-side tank 74, the first common supply pipe 81 and the individual supply pipes 101, 102, and 103. In addition, the ink that has a temperature controlled by the temperature controller 80 is supplied to the ejection modules 46, 45, and 44 via the supply-side tank 74, the second common supply pipe 82 and the individual supply pipes 106, 105, and 104.

Here, in a configuration in which the downstream side portion of the first common supply pipe 81 in the flow direction is not connected to the downstream side portion of the second common supply pipe 82 in the flow direction (first comparative example), when the ink that has a temperature controlled by the temperature controller 80 flows through the first common supply pipe 81 and the second common supply pipe 82, the ink is subjected to the influence of the external environment temperature, and thus the temperature of the ink gradually changes.

For this reason, the temperatures of the ink supplied to each of the ejection modules 41, 42, and 43 that are connected to the different positions of the first common supply pipe 81 in the flow direction change, and thus the variation in the temperatures of the ink between the ejection modules 41, 42, and 43 may occur in some cases. In addition, the temperatures of the ink supplied to each of the ejection modules 46, 45, and 44 that are connected to the different positions of the second common supply pipe 82 in the flow direction change, and thus the variation in the temperatures of the ink between the ejection modules 46, 45, and 44 may occur in some cases.

When the ink having a different temperature is respectively ejected from each of the ejection modules 41, 42, and 43 and each of the ejection modules 46, 45, and 44, ejection characteristics such as the ejection amount of the ink droplets or the ejection speed of the ink droplets vary, and thus there is a case where the image may be deteriorated.

The change in the temperature of the ink due to the influence of the external environment temperature includes a case where the temperature of the ink increases and a case where the temperature of the ink decreases. For example, in a case where the temperature of the ink is controlled to a temperature higher than the external environment temperature by the temperature controller 80, the controlled temperature of the ink decreases due to the influence of the external environment temperature. In a case where the temperature of the ink is controlled to a temperature lower than the external environment temperature by the temperature controller 80, the controlled temperature of the ink increases due to the influence of the external environment temperature.

In comparison with the first comparative example described above, in the present exemplary embodiment, the downstream side portion of the first common supply pipe 81 in the flow direction is connected to the downstream side portion of the second common supply pipe 82 in the flow direction via the heat transfer member 89. Therefore, in the downstream side portion of the first common supply pipe 81 in the flow direction and the downstream side portion of the second common supply pipe 82 in the flow direction, the area that is exposed to the outside is reduced, and thus the influence of the external environment temperature decreases, compared to the first comparative example described above.

Therefore, in a case where the ink that has a temperature controlled by the temperature controller 80 flows through the first common supply pipe 81 and the second common supply pipe 82, the temperature of the ink is not subject to the influence of external environmental temperature, and thus the temperature of the ink is unlikely to change, compared to the first comparative example described above.

Accordingly, compared to the first comparative example described above, the variation in temperature between the ejection modules 41, 42, and 43, and the variation in temperature between the ejection modules 46, 45, and 44 are suppressed. Therefore, compared to the first comparative example described above, a difference in ejection characteristics such as the ejection amount of the ink droplets or the ejection speed of the ink droplets due to the variation in the temperature of the ink is suppressed, and thus the degradation of the image can be suppressed.

In the present exemplary embodiment, the ejection modules 41, 42 and 43 are connected to the first common supply pipe 81 in order of the ejection modules 41, 42, and 43 from the upstream end side of the first common supply pipe 81 via the individual supply pipes 101, 102, and 103. The ejection modules 46, 45, and 44 are connected to the second common supply pipe 82 in order of the ejection modules 46, 45, and 44 from the upstream end side of the second common supply pipe 82 via the individual supply pipes 106, 105, and 104. Thus, the ink is supplied to each of the ejection modules 43 and 44 that are adjacent to each other, from the downstream side portion of the first common supply pipe 81 and the downstream side portion of the second common supply pipe 82.

Here, in a configuration in which the ejection modules 46, 45, and 44 are connected to the second common supply pipe 82 in order of the ejection modules 46, 45, and 44 from the downstream side portion of the second common supply pipe 82 via the individual supply pipes 106, 105, and 104 (second comparative example), the ink is supplied to the ejection module 44 that is adjacent to the ejection module 43, from the upstream side portion of the second common supply pipe 82 (the portion in which the influence of the external environment temperature is low). In addition, the ink is supplied to the ejection module 46 that is not adjacent to the ejection module 43, from the downstream side portion of the second common supply pipe 82.

In contrast, in the present exemplary embodiment, the ink is supplied to each of the ejection modules 43 and 44 that are adjacent to each other, from the downstream side portion of the first common supply pipe 81 and the downstream side portion of the second common supply pipe 82, in which the temperature of the ink is equalized by the connection through the heat transfer member 89. Therefore, compared to the second comparative example described above, a variation in the temperature of the ink between the ejection modules 43 and 44 that are adjacent to each other is suppressed.

<Evaluation>

In the present evaluation, the temperatures of the ink in each of the ejection modules 41 to 46 according to the present exemplary embodiment, the first comparative example, and the second comparative example, are measured.

Figure 4:
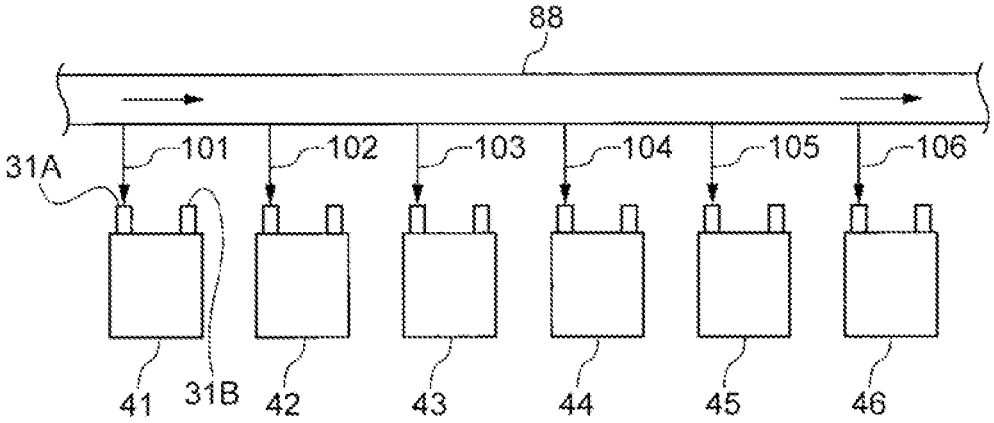
FIG. 4 is a schematic diagram illustrating the configuration of an ink supply mechanism according to a first comparative example.

In the first comparative example, as illustrated in FIG. 4, the ink circulates through single common supply pipe 88 from the supply-side tank 74 to each of the ejection modules 41 to 46, instead of the first common supply pipe 81 and the second common supply pipe 82. Each of the ejection modules 41 to 46 is connected to each of the different positions of the common supply pipe 88 in the flow direction via the individual supply pipes 101 to 106 in order of the ejection modules 41 to 46 from the upstream side of the common supply pipe 88 in the flow direction.

Figure 5:
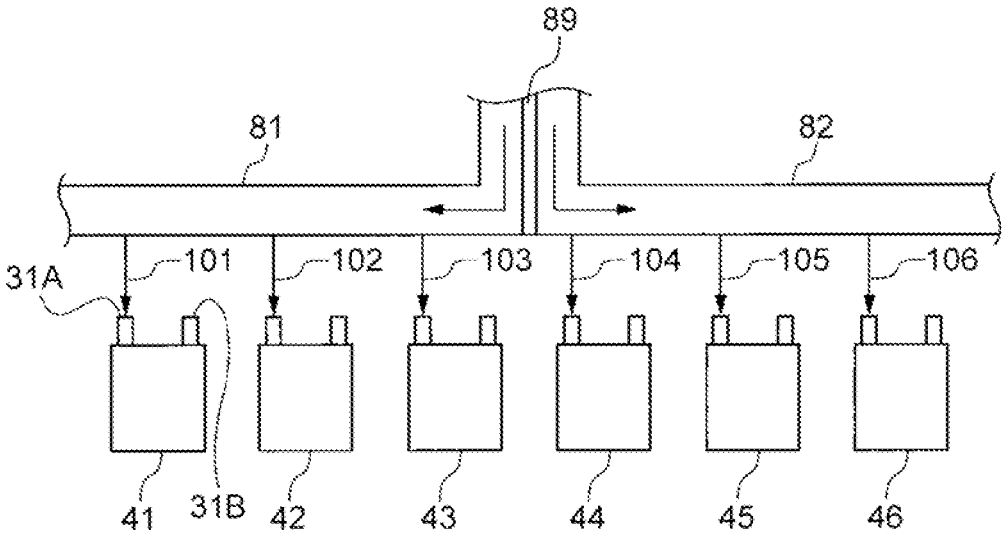
FIG. 5 is a schematic diagram illustrating the configuration of an ink supply mechanism according to a second comparative example.

In the second comparative example, as illustrated in FIG. 5, the upstream side portion of the first common supply pipe 81 opposite to the downstream side portion thereof in the flow direction is connected to the upstream side portion of the second common supply pipe 82 opposite to the downstream side portion thereof in the flow direction via the heat transfer member 89 that transfers heat.

Figure 6:
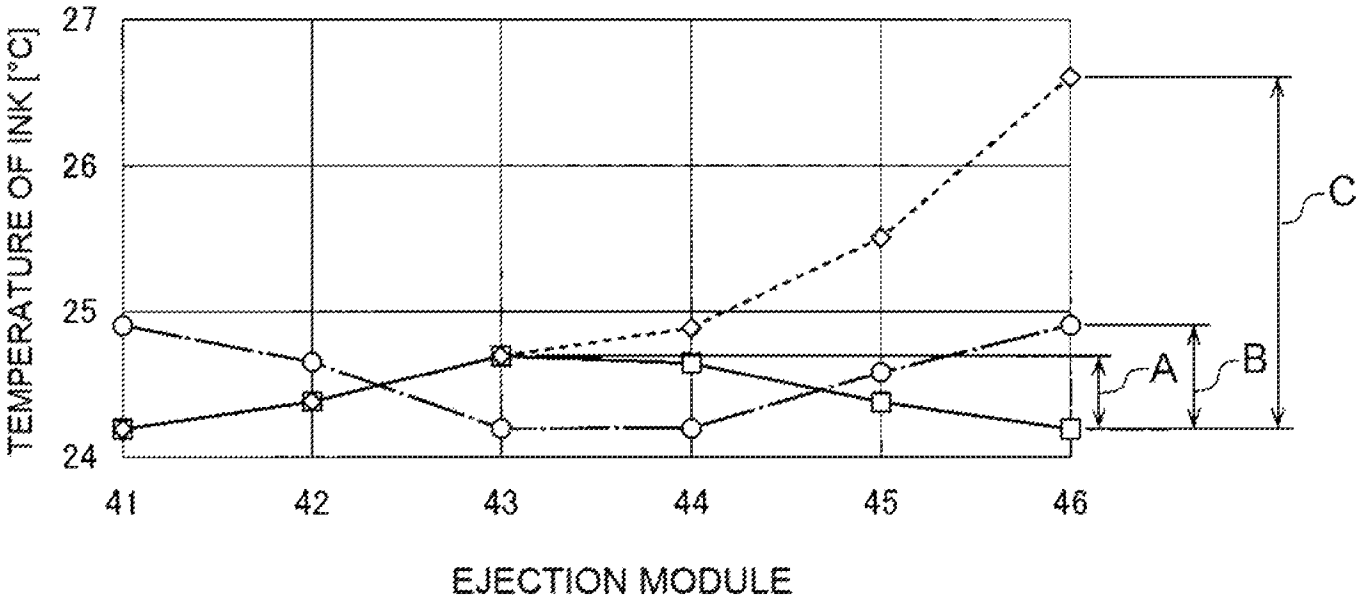
FIG. 6 is a graph illustrating the evaluation results.

The temperatures of the ink in each of the ejection modules 41 to 46 according to the present exemplary embodiment, the first comparative example, and the second comparative example, are measured. As a result, as illustrated in FIG. 6, the irregularity in the temperature (difference between the maximum temperature and the minimum temperature) is lower in order of the first comparative, example, the second comparative example, and the present exemplary embodiment (in FIG. 6, A<B<C).

Accordingly, in the present exemplary embodiment, compared to the first comparative example and the second comparative example, it is found that the variation in the temperature of the ink in each of the ejection modules 41 to 46 is suppressed.

<Ink Supply Mechanism 170 According to First Modification Example>

In the ink supply mechanism 70 described above, the two common supply pipes (the first common supply pipe 81 and the second common supply pipe 82) are disposed in series. In contrast, as the ink supply mechanism, three or more common supply pipes may be disposed in series.

Figure 7:
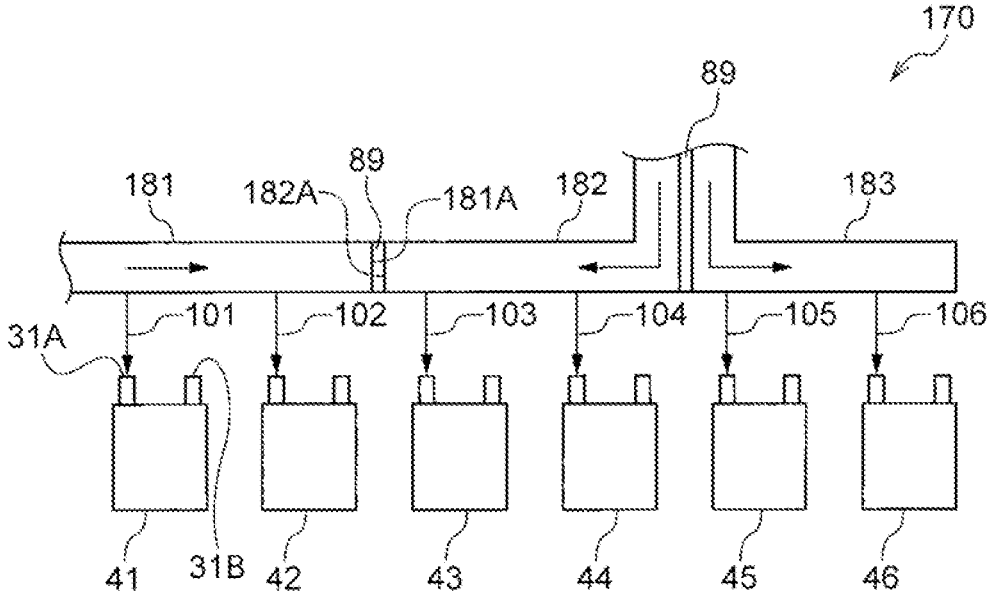
FIG. 7 is a schematic diagram illustrating the configuration of an ink supply mechanism according to a first modification example.

As illustrated in FIG. 7, the ink supply mechanism 170 according to the first modification example includes a first common supply pipe 181 (an example of one supply unit), a second common supply pipe 182 (an example of another supply unit), and a third common supply pipe 183 that circulate the ink that has a temperature controlled by the temperature controller 80 in a predetermined flow direction, instead of the first common supply pipe 81 and the second common supply pipe 82 in the ink supply mechanism 70.

Each of one ends of the first common supply pipe 181, the second common supply pipe 182, and the third common supply pipe 183 is connected to the supply-side tank 74.

The one ends of the individual supply pipes 101 and 102 are connected to the other end (downstream end side) of the first common supply pipe 181 opposite to the one end thereof, at each portion of the first common supply pipe 181 in the flow direction (different positions in the flow direction). More specifically the one ends of the individual supply pipes 101, and 102 are connected to the first common supply pipe 181 in order of the individual supply pipes 101 and 102 from the one end side (upstream end side) of the first common supply pipe 181.

The one ends of the individual supply pipes 104 and 103 are connected to the other end side (downstream end side) of the second common supply pipe 182 opposite to the one end thereof at each portion of the second common supply pipe 182 in the flow direction (different positions in the flow direction). More specifically, the one ends of the individual supply pipes 104, and 103 are connected to the second common supply pipe 182 in order of the individual supply pipes 104 and 103 from the one end side (upstream end side) of the second common supply pipe 182.

The one ends of the individual supply pipes 105 and 106 are connected to the other end side (downstream end side) of the third common supply pipe 183 opposite to the one end thereof, at each portion of the third common supply pipe 183 in the flow direction (different positions in the flow direction). More specifically, the one ends of the individual supply pipes 105, and 106 are connected to the third common supply pipe 183 in order of the individual supply pipes 105 and 106 from the one end side (upstream end side) of the third common supply pipe 183.

Here, in the ink supply mechanism 170, the downstream side portion of the first common supply pipe 181 in the flow direction is connected to the downstream side portion of the second common supply pipe 182 in the flow direction via the heat transfer member 89. Specifically, the downstream side end portion 181A of the first common supply pipe 181 in the flow direction is connected to the downstream side end portion 182A of the second common supply pipe 182 in the flow direction, and the first common supply pipe 181 and the second common supply pipe 182 are disposed in series.

The downstream side portion of the first common supply pipe 181 in the flow direction is, for example, a portion that is at the further downstream side in the flow direction than a portion in which the ejection module 41 that is disposed in second when counting from the downstream end side of the first common supply pipe 181 is connected to the first common supply pipe 181 (a connection portion between the first common supply pipe 181 and the individual supply pipe 101).

The downstream side portion of the second common supply pipe 182 in the flow direction is, for example, a portion that is at the further downstream side in the flow direction than a portion in which the ejection module 44 that is disposed in second when counting from the downstream end side of the second common supply pipe 182 is connected to the second common supply pipe 182 (a connection portion between the second common supply pipe 182 and the individual supply pipe 104).

The upstream side portion of the third common supply pipe 183 in the flow direction opposite to the downstream side portion thereof is connected to the upstream side portion of the second common supply pipe 182 opposite to the downstream side portion thereof, via the heat transfer member 89.

<Ink Supply Mechanism 270 According to Second Modification Example>

Figure 8:
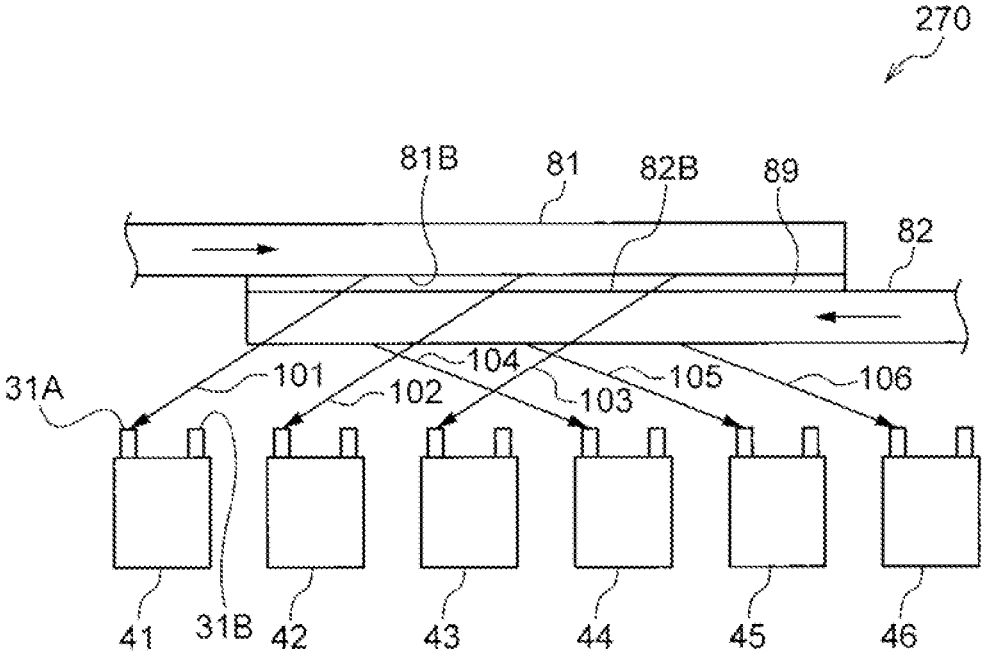
FIG. 8 is a schematic diagram illustrating the configuration of an ink supply mechanism according to a second modification example.

As illustrated in FIG. 8, in the ink supply mechanism 270, the downstream side portion of the first common supply pipe 81 in the flow direction is connected to the upstream side portion of the second common supply pipe 82 in the flow direction via the heat transfer member 89. The upstream side end portion of the first common supply pipe 81 in the flow direction is connected to the downstream side end portion of the second common supply pipe 82 in the flow direction via the heat transfer member 89.

In other words, each of the downstream side portion and the upstream side portion of the first common supply pipe 81 in the flow direction is connected to each of the upstream side portion and the downstream side portion of the second common supply pipe 82 in the flow direction, via the heat transfer member 89. Specifically, the side surface 81B of the first common supply pipe 81 (a part of the outer peripheral surface) is connected to the side surface 82B of the second common supply pipe 82 (a part of the outer peripheral surface), and the first common supply pipe 81 and the second common supply pipe 82 are disposed in parallel.

As described above, the downstream side portion of the first common supply pipe 81 in the flow direction is the portion described above, and the upstream side portion of the first common supply pipe 81 in the flow direction is a portion which is at the further upstream side in the flow direction than the downstream side portion thereof.

As described above, the downstream side portion of the second common supply pipe 82 in the flow direction is the portion described above, and the upstream side portion of the second common supply pipe 82 in the flow direction is to portion which is at the further upstream side in the flow direction than the downstream side portion thereof.

In the second modification example, in the first common supply pipe 81 and the second common supply pipe 82, heat exchange is made between the upstream side portion that is relatively close to the temperature controller 80 and relatively less influenced by the external environment temperature and the downstream side portion that is relatively far from the temperature controller 80 and relatively more influenced by the external environment temperature. Therefore, in each of the upstream side portions and the downstream side portions of the first common supply pipe 81 and the second common supply pipe 82, the variation in the temperature of the ink decreases.

Accordingly, the variation in the temperature of the ink between each of the ejection modules 41, 42, 43, 46, 45, and 44 is suppressed. Therefore, the difference in ejection characteristics such as the ejection amount of the ink droplets or the ejection speed of the ink droplets due to the irregularity in the temperature of the ink is suppressed, and thus the deterioration of the image can be suppressed.

<Evaluation>

Figure 9:
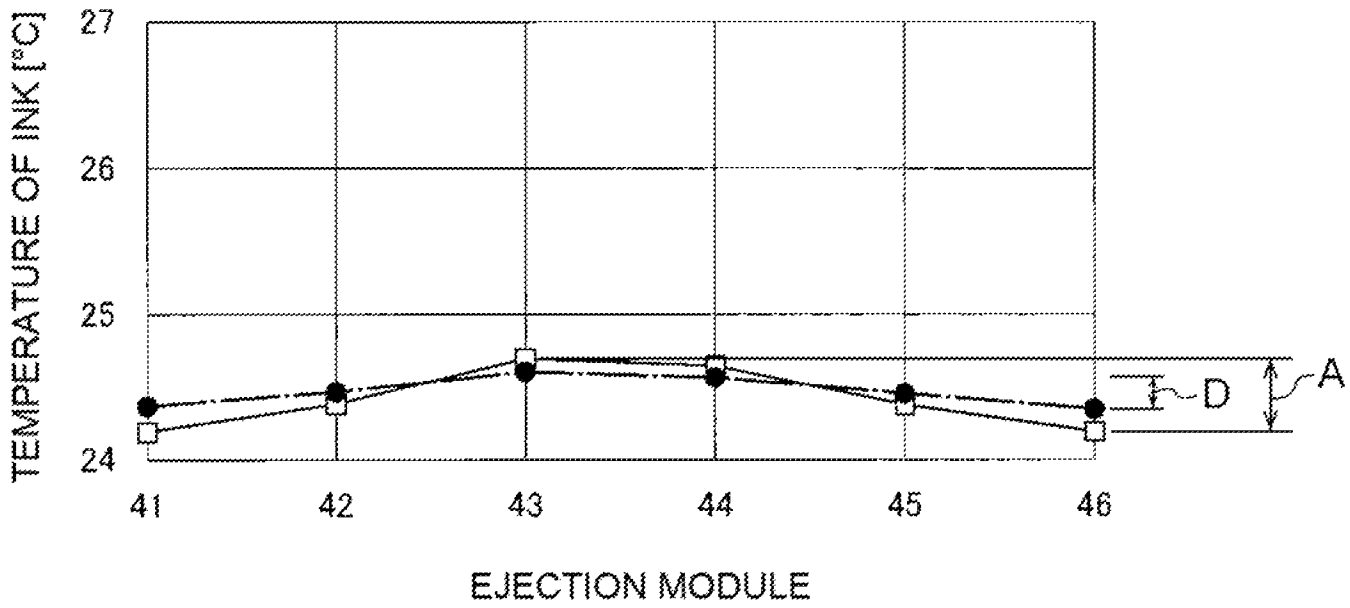
FIG. 9 is a graph illustrating the evaluation results of the ink supply mechanism according to the second modification example.

In the second modification example, the temperatures of the ink in each of the ejection modules 41 to 46 are measured. As a result, as illustrated in FIG. 9, the irregularity in the temperature (difference between the maximum temperature and the minimum temperature) is lower than the irregularity in the temperature at the ink supply mechanism 70 (in FIG. 9, D<A).

Ink Supply Mechanism 370 According to Third Modification Example

Figure 10:
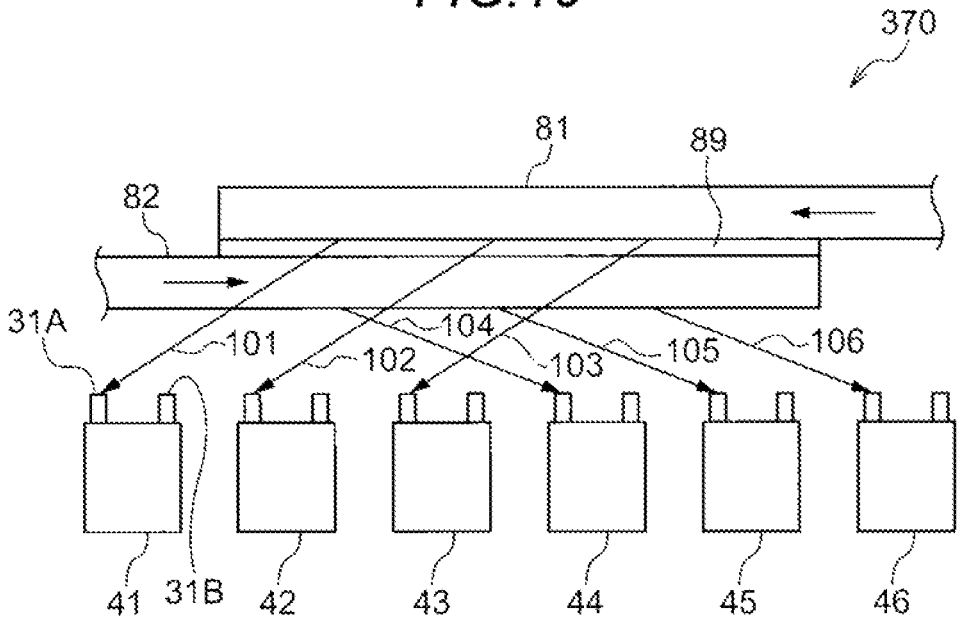
FIG. 10 is a schematic diagram illustrating the configuration of an ink supply mechanism according to a third modification example.

As illustrated in FIG. 10, the ink supply mechanism 370 is similar to the ink supply mechanism 270 in that the first common supply pipe 81 and the second common supply pipe 82 are disposed in parallel. However, the ink supply mechanism 370 is different from the ink supply mechanism 270 in the following aspects.

In the ink supply mechanism 370, the one ends of the individual supply pipes 101, 102 and 103 are connected to the first common supply pipe 81 in order of the individual supply pipes 103, 102, and 101 from the one end side (upstream end side) of the first common supply pipe 81. Therefore, the ink that flows through the first common supply pipe 81 is supplied in order of the ejection modules 43, 42, and 41.

The one ends of the individual supply pipes 106, 105, and 104 are connected to the second common supply pipe 82 in order of the individual supply pipes 104, 105, and 106 from the one end side (upstream end side) of the second common supply pipe 82. Therefore, the ink that flows through the second common supply pipe 82 is supplied in order of the ejection modules 44, 45, and 46.

<Ink Supply Mechanism 470 According to Fourth Modification Example>

In the ink supply mechanisms 270 and 370 described above, the two common supply pipes (the first common supply pipe 81 and the second common supply pipe 82) are disposed in parallel. In contrast, as the ink supply mechanism, three or more common supply pipes may be disposed in parallel.

Figure 11:
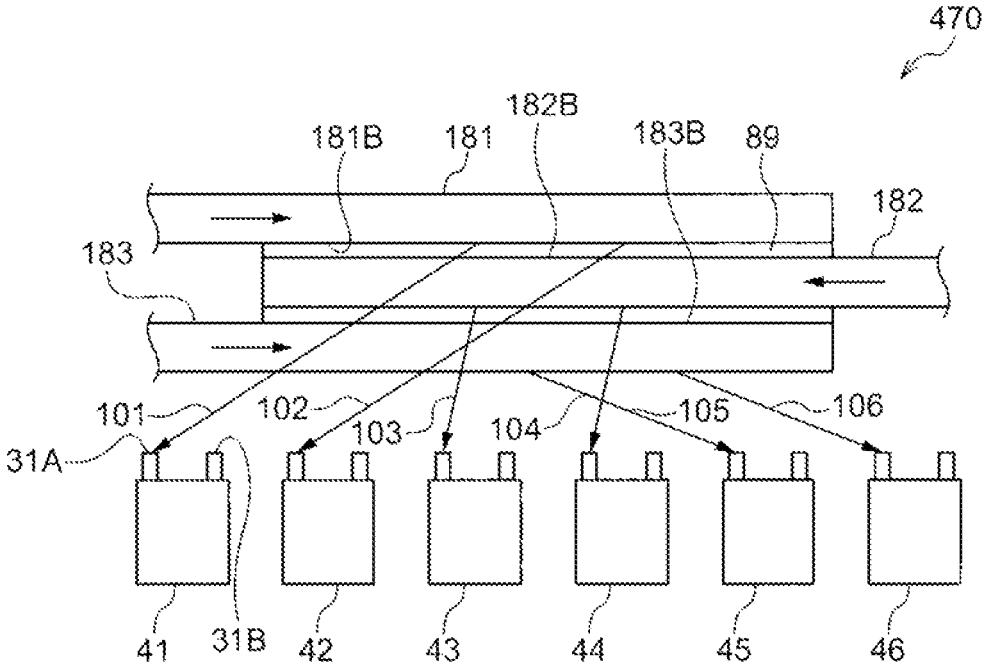
FIG. 11 is a schematic diagram illustrating the configuration of an ink supply mechanism according to a fourth modification example.

As illustrated in FIG. 11, the ink supply mechanism 470 according to the fourth modification example includes a first common supply pipe 181 (an example of one supply unit), a second common supply pipe 182 (an example of another supply unit), and a third common supply pipe 183 (an example of one supply unit) that circulate the ink that has a temperature controlled by the temperature controller 80 in a predetermined flow direction, instead of the first common supply pipe 81 and the second common supply pipe 82 in the ink supply mechanisms 270 and 370.

Each of one ends of the first common supply pipe 181, the second common supply pipe 182, and the third common supply pipe 183 is connected to the supply-side tank 74.

The one ends of the individual supply pipes 101 and 102 are connected to the other end (downstream end side) of the first common supply pipe 181 opposite to the one end thereof, at each portion of the first common supply pipe 181 in the flow direction (different positions in the flow direction). More specifically, the one ends of the individual supply pipes 101, and 102 are connected to the first common supply pipe 181 in order of the individual supply pipes 101 and 102 from the one end side (upstream end side) of the first common supply pipe 181.

The one ends of the individual supply pipes 104 and 103 are connected to the other end side (downstream end side) of the second common supply pipe 182 opposite to the one end thereof, at each portion of the second common supply pipe 182 in the flow direction (different positions in the flow direction). More specifically, the one ends of the individual supply pipes 104, and 103 are connected to the second common supply pipe 182 in order of the individual supply pipes 104 and 103 from the one end side (upstream end side) of the second common supply pipe 182.

The one ends of the individual supply pipes 105 and 106 are connected to the other end side (downstream end side) of the third common supply pipe 183 opposite to the one end thereof, at each portion of the third common supply pipe 183 in the flow direction (different positions in the flow direction). More specifically, the one ends of the individual supply pipes 105, and 106 are connected to the third common supply pipe 183 in order of the individual supply pipes 105 and 106 from the one end side (upstream end side) of the third common supply pipe 183.

Here, in the ink supply mechanism 470, the downstream side portion and the upstream side portion of the first common supply pipe 181 in the flow direction are respectively connected to the upstream side portion and the downstream side portion of the second common supply pipe 182 in the flow direction via the heat transfer member 89. In addition, the downstream side portion and the upstream side portion of the third common supply pipe 183 in the flow direction are respectively connected to the upstream side portion and the downstream side portion of the second common supply pipe 182 in the flow direction via the heat transfer member 89.

Specifically, the side surface 181B of the first common supply pipe 181 (a part of the outer peripheral surface) is connected to the side surface 182B of the second common supply pipe 182 (a part of the outer peripheral surface), and the first common supply pipe 181 and the second common supply pipe 182 are disposed in parallel. In addition, the side surface 183B of the third common supply pipe 183 (a part of the outer peripheral surface) is connected to the side surface 182B of the second common supply pipe 182 (a part of the outer peripheral surface), and the third common supply pipe 183 and the second common supply pipe 182 are disposed in parallel.

The downstream side portion of the first common supply pipe 181 in the flow direction is, for example, a portion that is at the further downstream side in the flow direction than a portion in which the ejection module 41 that is disposed in second when counting from the downstream end side of the first common supply pipe 181 is connected to the first common supply pipe 181 (a connection portion between the first common supply pipe 181 and the individual supply pipe 101).

The downstream side portion of the second common supply pipe 182 in the flow direction is, for example, a portion that is at the further downstream side in the flow direction than a portion in which the ejection module 44 that is disposed in second when counting from the downstream end side of the second common supply pipe 182 is connected to the second common supply pipe 182 (a connection portion between the second common supply pipe 182 and the individual supply pipe 104).

The downstream side portion of the third common supply pipe 183 in the flow direction is, for example, a portion that is at the further downstream side in the flow direction than a portion in which the ejection module 45 that is disposed in second when counting from the downstream end side of the third common supply pipe 183 is connected to the third common supply pipe 183 (a connection portion between the third common supply pipe 183 and the individual supply pipe 105).

Each of the upstream side portions of the first common supply pipe 181, the second common supply pipe 182, and the third common supply pipe 183 in the flow direction is a portion which is at the further upstream side in the flow direction than each of the downstream side portions of the first common supply pipe 181, the second common supply pipe 182, and the third common supply pipe 183.

<Other Modification Example>

In the exemplary embodiments and the modification examples described above, the downstream side portions of the second common supply pipes 82 and 182 as an example of another supply unit are connected to the first common supply pipes 81 and 181 as an example of one supply unit via the heat transfer member 89. However, the downstream side portions of the second common supply pipes 82 and 182 are not limited thereto, and may not be connected to the first common supply pipes 81 and 181.

In the exemplary embodiments and the modification examples described above, the ink is used as an example of a liquid. However, the liquid is not limited to the ink, and a liquid other than the ink may be used.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An ejection apparatus comprising:

a plurality of ejection units that eject a liquid;

a controller that controls a temperature of the liquid; and a supply mechanism that includes a plurality of supply units, wherein the plurality of supply units flow the liquid having a temperature controlled by the controller in a predetermined flow direction, wherein respective portion of the plurality of supply units in the flow direction are connected to the ejection units to supply the liquid to the ejection units, and wherein a downstream side portion of one of the supply units in the flow direction is connected to another one of supply units via a heat transfer member.

2. The ejection apparatus according to claim 1, wherein the downstream side portion of the one of supply units is connected to a downstream side portion of the another one of the supply units in the flow direction via the heat transfer member.

3. The ejection apparatus according to claim 2, wherein the plurality of ejection units are disposed along a predetermined disposition direction, wherein the plurality of ejection units include a first ejection unit that is disposed at a center side in the disposition direction, a second ejection unit that is disposed at one end in the disposition direction, a third ejection unit that is adjacent to the first ejection unit at the other end side in the disposition direction with respect to the first ejection unit, and a fourth ejection unit that is disposed at the other end in the disposition direction, wherein the plurality of ejection units from the first ejection unit to the second ejection unit are connected to the one of the supply units in order, at each portion from the downstream side portion to the upstream side portion of the one of the supply units, and wherein the plurality of ejection units from the third ejection unit to the fourth ejection unit are connected to the another one of the supply unit in order, at each portion from the downstream side portion to the upstream side portion of the another one of the supply units.

4. The ejection apparatus according to claim 1, wherein the downstream side portion of the one of the supply units is connected to an upstream side portion of the another one of the supply units in the flow direction via the heat transfer member, and wherein an upstream side portion of the one of the supply units in the flow direction is connected to a downstream side portion of the another one of the supply units in the flow direction via the heat transfer member.

5. The ejection apparatus according to claim 4, wherein the plurality of ejection units are disposed along a predetermined disposition direction, wherein the plurality of ejection units include a first ejection unit that is disposed at a center side in the disposition direction, a second ejection unit that is disposed at one end in the disposition direction, a third ejection unit that is adjacent to the first ejection unit at the other end side in the disposition direction with respect to the first ejection unit, and a fourth ejection unit that is disposed at the other end in the disposition direction, wherein the plurality of ejection units from the first ejection unit to the second ejection unit are connected to the one of the supply units in order, at each portion from the downstream side portion to the upstream side portion of the one of the supply units, and wherein the plurality of ejection units from the third ejection unit to the fourth ejection unit are connected to the another one of the supply unit in order, at each portion from the downstream side portion to the upstream side portion of the another one of the supply units.

* * * * *